US006878033B2

(12) United States Patent
Luk

(10) Patent No.: US 6,878,033 B2
(45) Date of Patent: Apr. 12, 2005

(54) MULTI-PANEL MOLDED BRASSIERE CUP AND RELATED METHODS OF MANUFACTURE

(75) Inventor: Theone Luk, Kwai Chung (HK)

(73) Assignee: Regina Miracle International Limited (HK)

( * ) Notice: Subject to any disclaimer, the term of this patent is extended or adjusted under 35 U.S.C. 154(b) by 146 days.

(21) Appl. No.: 10/354,244

(22) Filed: Jan. 29, 2003

(65) Prior Publication Data

US 2004/0147203 A1 Jul. 29, 2004

(51) Int. Cl.[7] ..... A41C 3/00
(52) U.S. Cl. ..... 450/39; 450/57
(58) Field of Search ..... 450/1, 39, 54–57, 450/90, 92, 93; 2/267, 268, 243.1, 69, 73, 78.1–78.4; 264/257, 258, 291, 292, 294, 320, 321, 145, 152–155, 157–160, 163; 156/245

(56) References Cited

U.S. PATENT DOCUMENTS 3,392,731 A * 7/1968 Silverman ..... 450/57
3,399,678 A * 9/1968 Faron ..... 450/55
4,202,853 A * 5/1980 DiTullio ..... 264/138
4,244,249 A * 1/1981 DiTullio ..... 83/139

* cited by examiner

*Primary Examiner*—Gloria M. Hale
(74) *Attorney, Agent, or Firm*—Ostrolenk, Faber, Gerb & Soffen, LLP

(57) ABSTRACT

A breast cup of a cup shape for a or as part of a brassiere comprising a first molded panel of a multi-ply material and at least one other molded panel of a multi-ply material. The panels define a cup shape and are engaged to an adjacent panel in a tessellated manner by stitching along abutting edges of the panels. Each panel has a convex side ply of a fabric material of a different color to the panel(s) to which it is engaged.

23 Claims, 7 Drawing Sheets

MULTI-PANEL MOLDED BRASSIERE CUP AND RELATED METHODS OF MANUFACTURE

FIELD OF THE INVENTION

The present invention relates to a molded multi-panel brassiere cup and related methods of manufacturing. In particular although not solely it relates to the provision of a molded brassiere cup which is made from multi-panels of material which are each affixed to each other and include embroidery to conceal the seams.

BACKGROUND TO THE INVENTION

The construction of a brassiere (herein after referred to as "bra") consists of many components and the assemblage of these components into a final product is time consuming. The assembly process is often the most time consuming of the manufacturing process and is the biggest singular cost component. Thus any reduction at this stage is of an advantage.

The aesthetic appeal is also an important consideration in the production of a bra, and is often the most important aspect in the purchasing decision made by a potential purchaser. From a marketing point this is the biggest product differentiator.

However the two aspects of cost of construction and aesthetics are competing components and traditionally at odds with one another. Technology and improvements in design and machinery are allowing the components to be combined and a cost advantage to be realized.

It is therefore an object of the present invention to provide to a breast cup construction of or for a bra construction, of aesthetic appeal and of low cost manufacturing or at least gives the public a useful choice.

BRIEF DESCRIPTION OF THE INVENTION

Accordingly the present invention consists in a method of making a molded brassiere cup comprising the steps of:

(a) taking a first and at least one other molded cup each comprising of an outer layer of fabric material at the convex side of said cup and at least one layer of or including a foam layer adhered to said outer layer of fabric material on the concave side of said cup, said outer layer of fabric material of at least two of said first and at least one other molded cup being of a different color (b) cutting each said cup into at least two portions said cutting being identical for each said first and said at least one other molded cup to define at least two separated portions of each respective cup to generate at least two separated portions of identical shape (c) fixing along at least part of a cut edge of separated portion(s) cut from the first cup, the at least part of the complementary shaped cut edge of a separated portion(s) cut from at least one other cup to define a multi-panel cup form substantially of the same shape as said first and said at least one other molded cups.

Preferably said fixing includes embroidering along the mating boundary of said panels of said multi-panel cup.

Preferably said fixing includes stitching along the mating boundary(s) of said panels of said multi-panel cup prior to embroidering along said boundary.

Preferably further including the molding of said first and said at least one other molded cups prior to their cutting by placing a precursor sheet of (a) an outer layer of fabric material and (b) at least one layer of or including a foam layer adhered to said outer layer of fabric material such that said outer fabric layer is facing a concave shaped molding portion of a molding machine and said at least one layer faces the convex shaped molding portion of said molding machine, and molding said precursor between said molding portions.

Preferably said multi-panel cup after said fixing has adhered to the concave side thereof an cover sheet of at least one ply of material to cover at least said boundary(s) between said panels of said multi-panel cup.

Preferably said cover sheet is adhered to said multi-panel cup by the provision of a molding force thereto.

Preferably said molding force is applied by said two molding portions.

Preferably said cover sheet is at least co extensive with the multi-panel cup.

In a second aspect the present invention consists in a method of making a multi-panel cup for a brassiere comprising;

fixing together at least two panels each generated by the cutting thereof from separately molded cups each being of a different convex side color to define a cup shape substantially identical to the shape of each separately molded cup.

Preferably said fixing together is by stitching.

Preferably fixing includes embroidering after said stitching.

Preferably said embroidering defines elongate embroidery along the joint of said at least two panels.

Preferably some of said embroidery also extends onto at least one of the panels away from said joint.

In a further aspect the present invention consists in a cup made in accordance to the method as herein before described In a further aspect the present invention consists in a breast cup of a cup shape for a or as part of a brassiere comprising;

a first molded panel of a multiply material at least one other molded panel of a multiply material said panels defining said cup shape and each panel is engaged to an adjacent panel in a tessellated manner by stitching along abutting edges of said panels wherein each said panel has a convex side ply of a fabric material of a different color to a panel to which it is engaged.

Preferably said abutting edges include an embroidered stitching.

Preferably over said stitching there is provided a line of embroidery.

Preferably a cover sheet is applied to the concave side of said panels substantially coextensive with said cup shape.

Preferably a multi-ply material of said panels includes said ply of fabric material with which and on the concave side thereof there is affixed a ply of foam material.

Preferably said cover sheet includes a ply of foam material affixed to the foam material of said panels and a ply of fabric material on the concave side of said second mentioned foam material.

Preferably said embroidery may also extend onto at least one panel at regions away from its abutting edge(s).

In still a further aspect the present invention consists in a brassiere incorporating two breast cups each as herein before described.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

The present invention may be embodied in other specific forms without departing from the spirit or essential attributes thereof and accordingly reference should be made to the appended claims rather than the foregoing specification as indicating the scope of the invention.

DETAILED DESCRIPTION OF THE INVENTION

Figure 10:
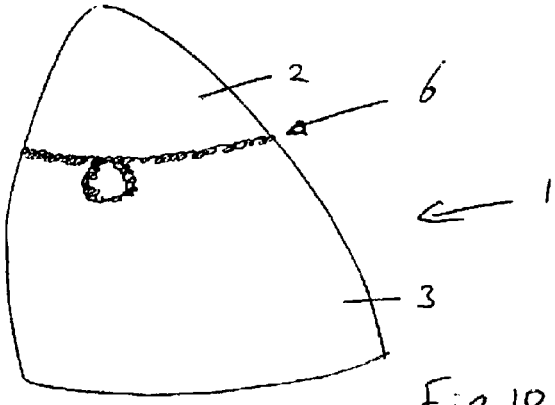
FIG. 10 illustrates a cup shape having been cut from the result of FIG. 9.
Figure 11:
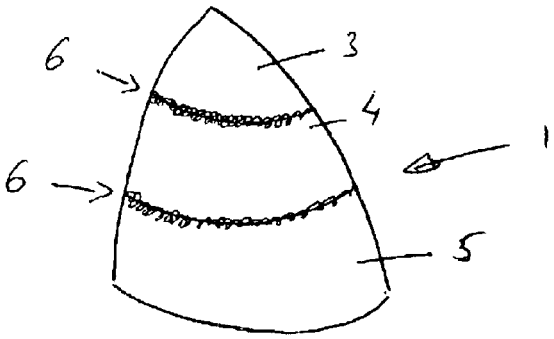
FIG. 11 illustrates a cup of a three panel form which may be provided by the method of the present invention.

With reference to FIGS. 10 and 11 there are shown breast cups for the inclusion in a brassiere construction. The breast cups 1 are made of at least two panels 2, 3 and possibly additional panels such as panel 5. The cups 1 are of a three dimensional form which are designed to support the breast of a wearer of a brassiere which incorporates the cups of the present invention. The multi-panel cup will provide to the exterior of the brassiere, a contrast in colours of adjacent panels. Where for example the cup consists of two panels as shown in FIG. 10, the exterior surface of the cup will be of two different colours. In the example as shown in FIG. 11, panels 3 and 5 may be of a different colour to panel 4 and panel 3 and 5 may also be of different colours to each other.

The cups are made of panels which are of a molded form, at least part of each of the panels have been molded to part of the cup shape.

Each panel is affixed to an adjacent panel along abutting boundaries 6.

Reference will now be made to further details of the cups by reference to FIGS. 1 to 9 which illustrates the sequence of preferred manufacture.

Figure 1:
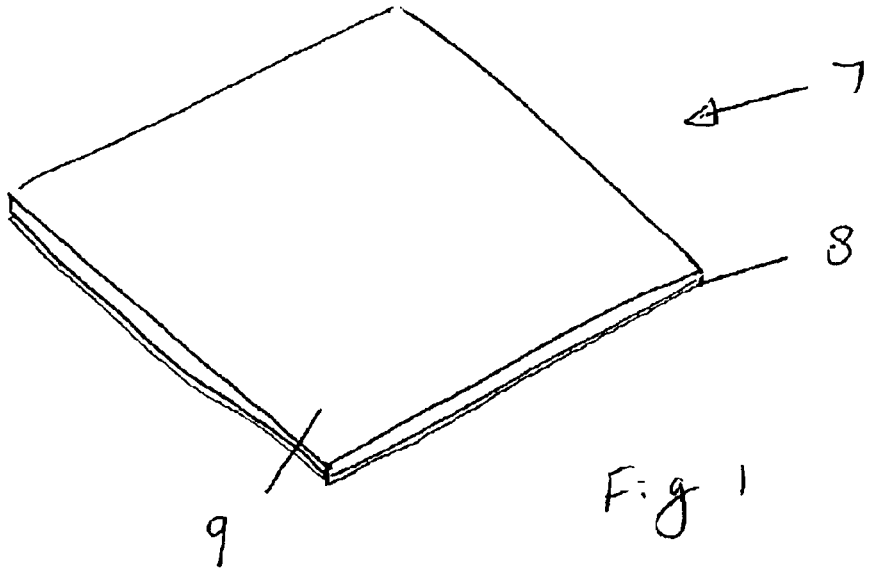
FIG. 1 illustrates a perspective view of a precursor sheet of material for the molding of part of the present invention.

With reference to FIG. 1 there is shown a multi-ply sheet of material 7. This multi-ply sheet of material includes a ply of fabric material 8 onto which at least one other ply of material 9 is provided. The at least one other ply of material 9 is or includes a foam sheet such as for example a urethane foam.

The ply of fabric material 9 may for example be of a polyester based cotton, LYCRA, spandex or nylon or the like. It will form part of the exterior most surface (convex side) of the finished cup. (convex side) of the finished cup.

Figure 2:
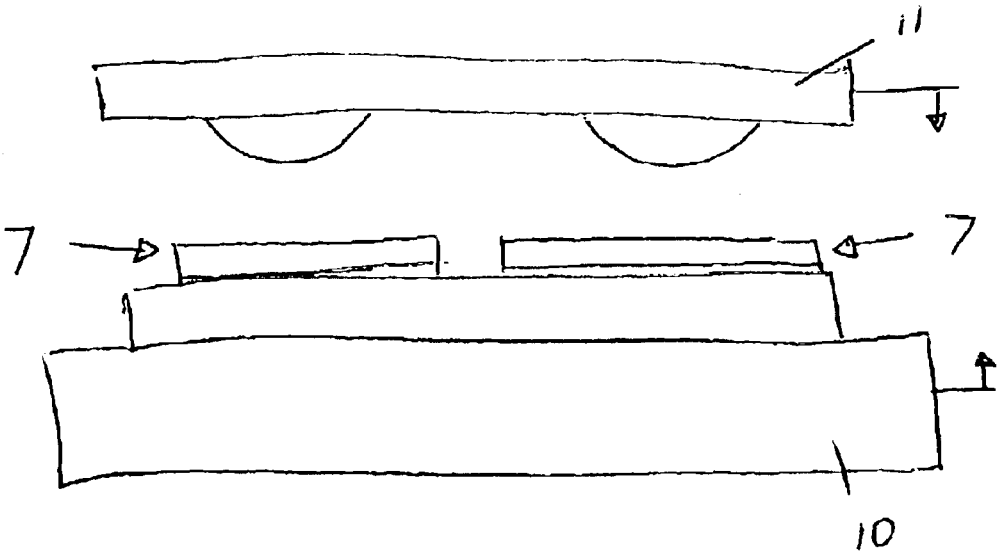
FIG. 2 is a side view of two sheets as shown in FIG. 1 provided intermediate of two molding portions prior to a three dimensional cup shape being molded into the material.
Figure 3:
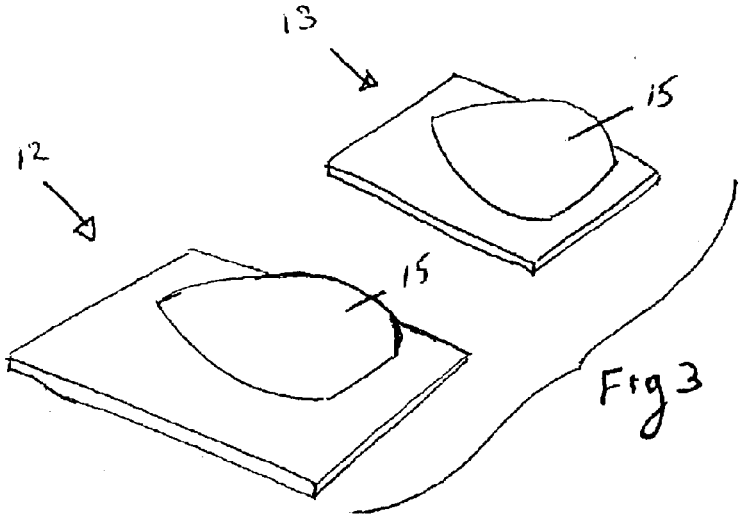
FIG. 3 is a perspective view of the two sheets of FIG. 2 having the three dimensional cup shape molded therein.

With reference to FIG. 2, the sheet of material 7 is placed on a molding machine and two mold portions 10, 11 are brought together to mold a three dimensional cup form in the sheet 7. With reference to FIG. 2, it can be seen that more than one sheet 7 can be molded simultaneously. Whether or not the same molding machine molds one or more cups simultaneously, the resulted moldings as shown in FIG. 3 may be provided for the purposes of creating a finished breast cup of the present invention. The first molded sheet 12 and the second molded sheet 13 each define a substantially similar shaped cup form 15.

Figure 4:
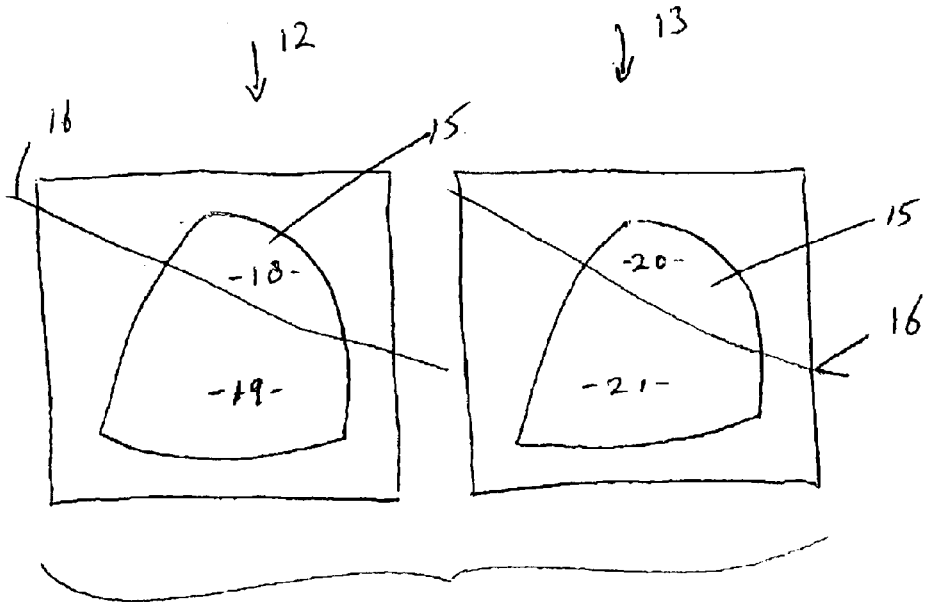
FIG. 4 illustrates a line of cutting to cut said two cups into two panels.

With reference to FIG. 4, the two moldings are able to be cut along a line 16 the line 16 is substantially the same across the cup forms 15 of both molded sheets 12 and 13. By cutting the moldings 12 and 13, separated cup panels 18, 19 are provided from the first molding 12 and separate cup panels 20, 21 are provided from the second molding 13. In the example where a cup of two panels is provided, two moldings 12 and 13 need to be provided and from which two identical shaped two panel finished cups can be manufactured. Where a three panel cup is to be provided, three moldings will need to be provided each from which a separate panel for the three paneled finished form cup shape can be generated.

Figure 5:
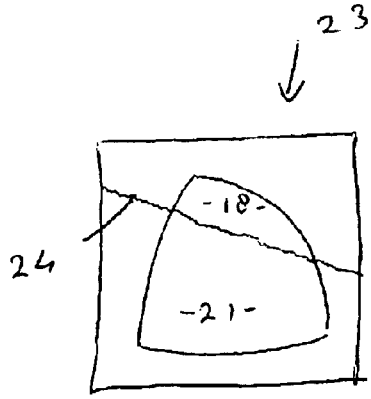
FIG. 5 is a plan view of two panels stitched together.
Figure 6:
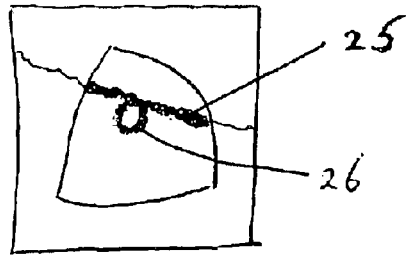
FIG. 6 is a plan view of FIG. 5 but wherein the addition of embroidery is provided.

With reference to FIG. 5, the panel 18 of the first molding 12 is affixed to the panel 21 of the second molding 13. Likewise an assembly can be generated from the second panel 19 of the first molding and the first panel 20 of the second molding 13 to thereby also create a substantially similar shaped assembly. The affixing of the panels from the separate moldings together is preferably achieved by stitching along the cut edges. Such stitching may for example be by an overlocking or similar nature. Alternatively adhesion of the cut edges may also provide the suitable affixing of panels from the separate moldings 12, 13. The at least two panels forming the assembly 23 as shown in FIG. 5, each panel generated from a separate molding, may in addition to the stitching 24 include at least across the cup form of the assembly 23 an embroidery 25. Such embroidery will enhance the appearance of the convex and hence exterior side of the cup by overlying the stitching of the seam between the two panels. In addition, such embroidery may extend onto at least one of the panels at a region 26 thereof, away from the seam between the two panels.

Figure 7:
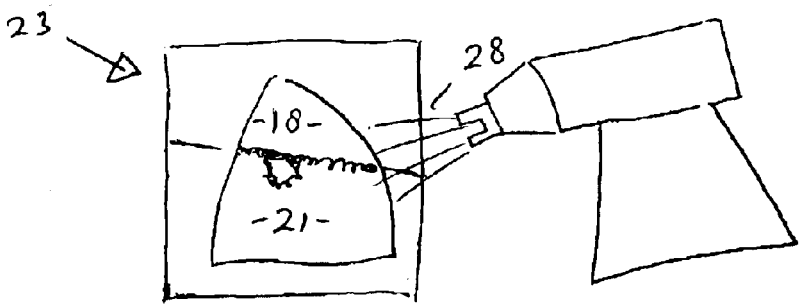
FIG. 7 illustrates the reverse side of the panel of FIG. 6 being sprayed with an adhesive.
Figure 8:
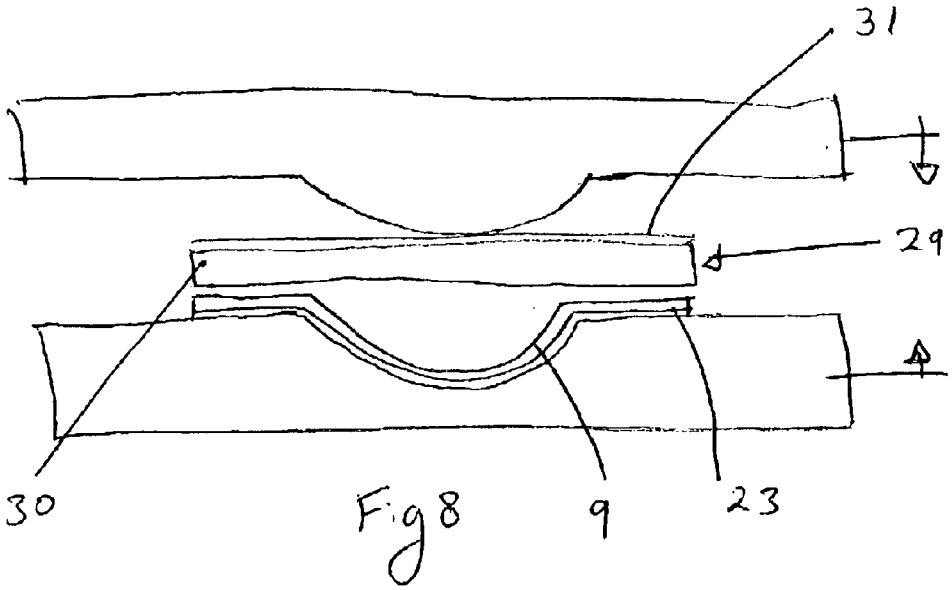
FIG. 8 illustrates a second sheet of material intermediate of said two molding portions and between the panel of FIG. 7 and the upper mold portion prior to being molded together.
Figure 9:
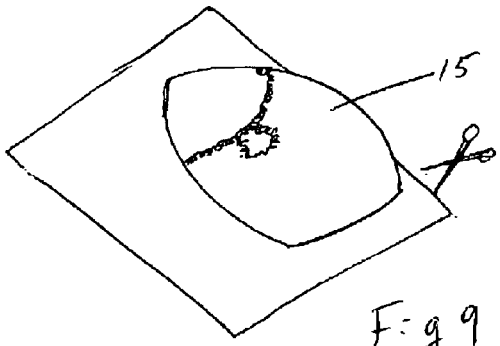
FIG. 9 is a perspective view of the resultant from the molding of step 8.

As a further step, the interior (concave side) of the assembly may have a further sheet (covering sheet) affixed thereto. With reference to FIG. 7, the interior surface of the assembly 23 may for example be sprayed with an adhesive 28 to which a covering sheet can be affixed. Such a covering sheet 29 may be affixed to the interior surface of the assembly 23 by molding as for example shown in FIG. 8.

The covering sheet itself may be of a similar construction to the multi-panel sheet assembly 23 wherein the foam layer 30 is adhered to the foam layer 9 of the multi panel assembly. Likewise the exterior surface 31 of the cover sheet 29 which will form the concave most side of the assembly is also of a fabric material.

The then assembled cup shape with the covering sheet attached may be cut to remove the cup form 15 by trimming away the excess material at the perimeter thereof. In this manner both the molding 12 and the cover sheet 29 are trimmed simultaneously to define a cup shape as for example shown in FIG. 10.

Figure 12:
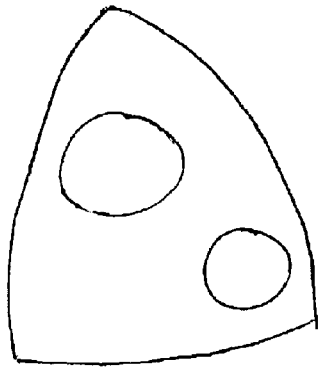
FIG. 12 shows a cup construction wherein three panels are provided but where two panels are completely encompassed by the other panels, and FIGS. 13(*a*) to 13(*v*) illustrate examples of multi-paneled cups that may be formed.
Figure 13A:
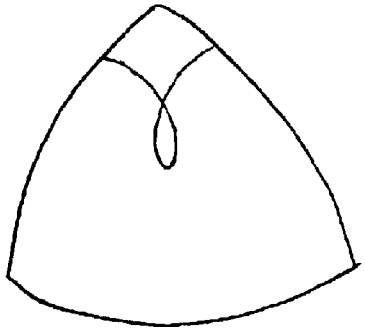
Figure 13B:
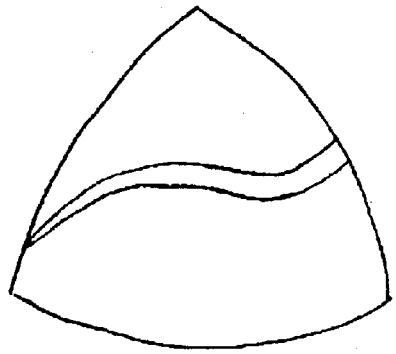
Figure 13C:
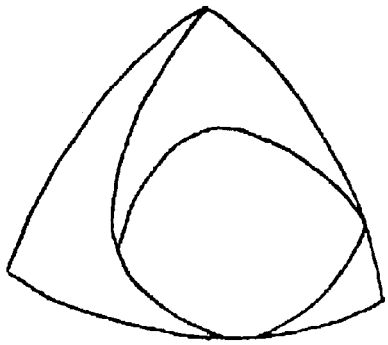
Figure 13D:
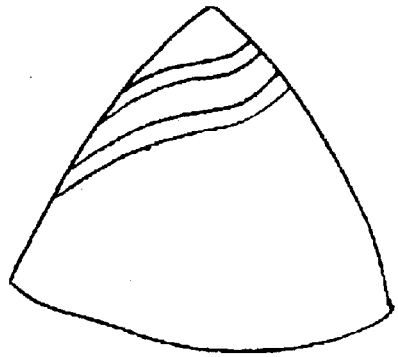
Figure 13E:
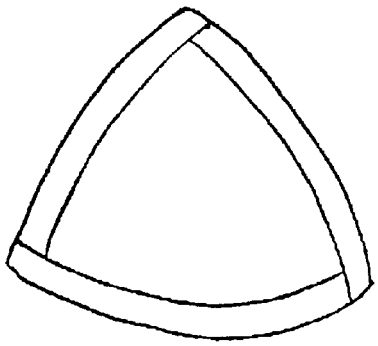
Figure 13F:
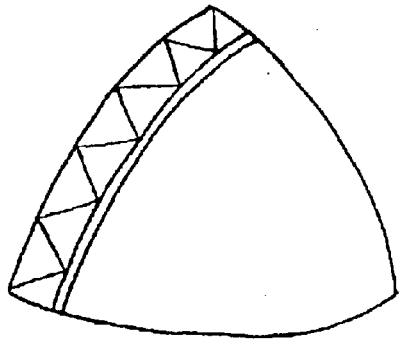
Figure 13G:
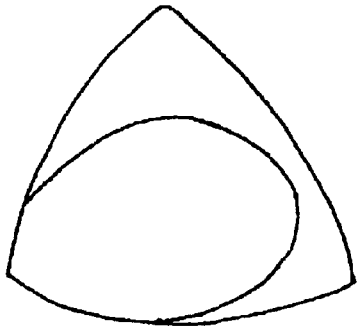
Figure 13H:
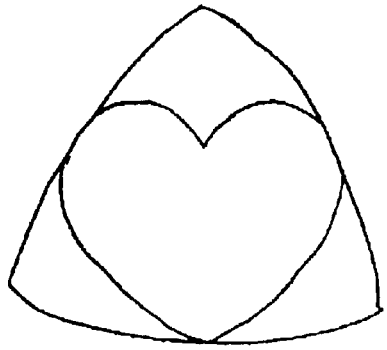
Figure 13I:
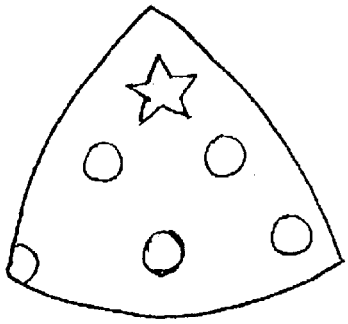
Figure 13J:
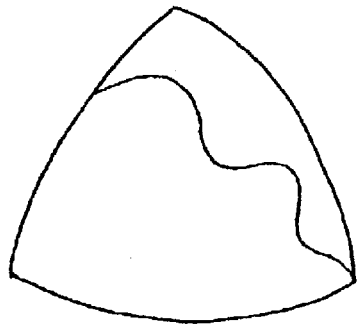
Figure 13K:
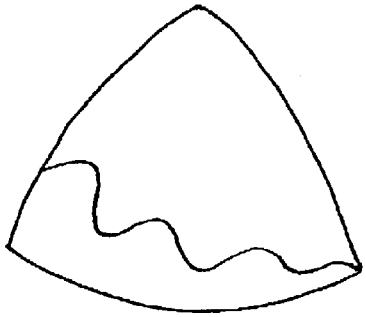
Figure 13L:
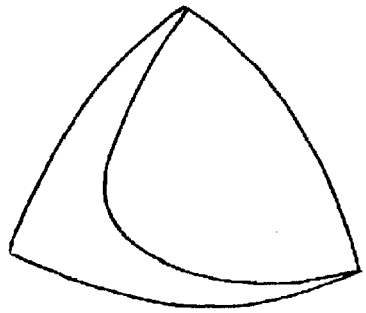
Figure 13M:
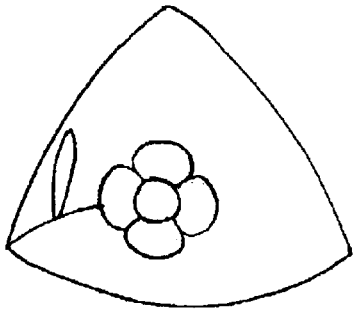
Figure 13N:
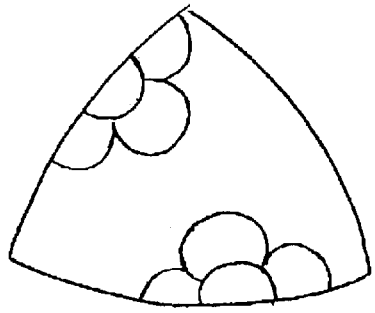
Figure 13O:
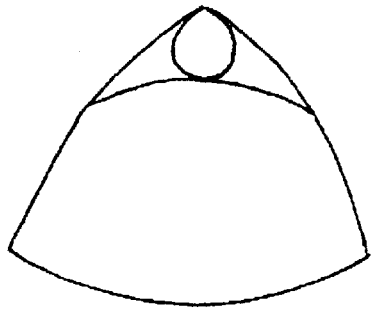
Figure 13P:
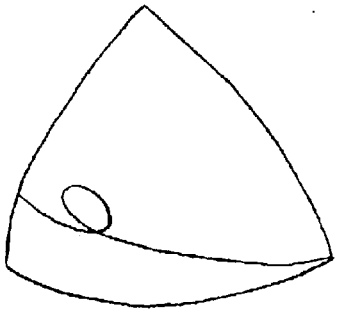
Figure 13Q:
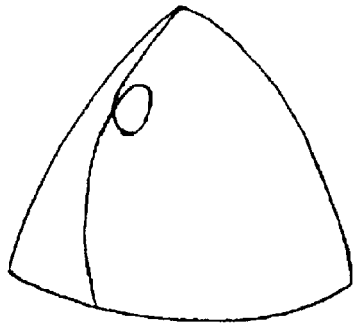
Figure 13R:
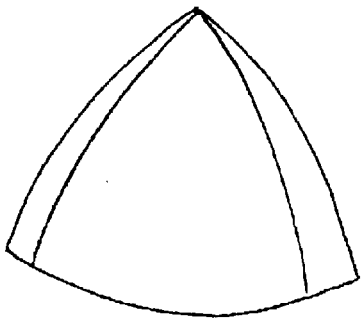
Figure 13S:
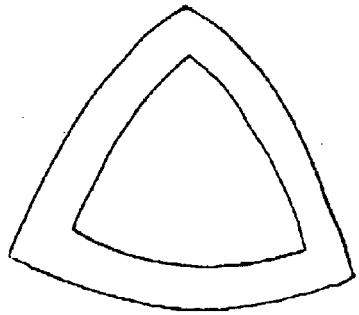
Figure 13T:
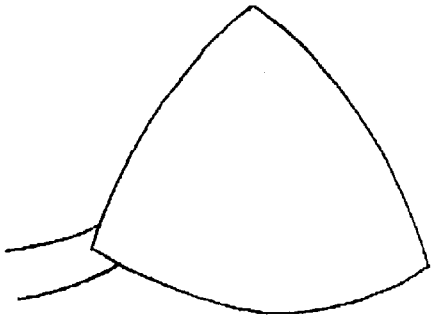
Figure 13U:
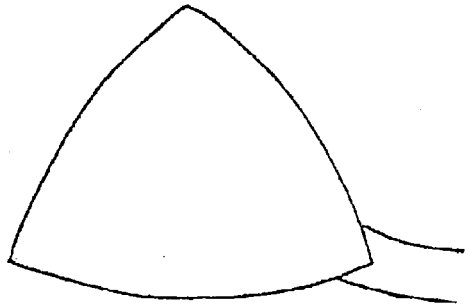
Figure 13V:
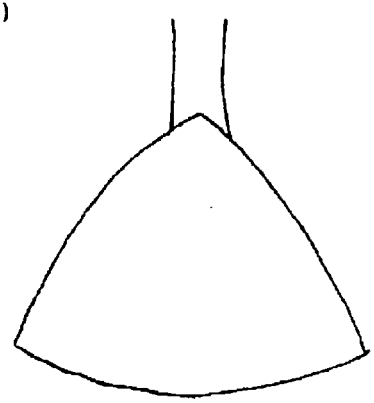

FIG. 12 shows an alternative design wherein three panels are provided, two of which are bounded by the one larger panel. In this example the larger panel has been generated from a molded cup by having two circular panels removed therefrom. The two apertures that are then left are occupied by circular panels of complementary shape to the apertures generated from a different cup or cups. The two circular panels may be generated from the same cup and hence of the same color (but different to the main panel) or from different cups and hence may be of different colors to each other.

In alternative configurations the cup that is constructed from at least two panels may not have the entire boundary of complementary shaped cut edges engaged to each other. It is envisaged that some of the boundary of the adjacent edges may be free of engagement to each other and whereat an aperture through the cup bra may be provided. Such unattached edges may hence form part of the boundary of an aperture in the cup. Any such edges which remain free may be overlocked or embroided to provide a neatly trimmers and presented edge.

Whist reference herein is made to the cutting of at least two cups in identical manners so as to provide at least two panels to be sewn together, it is to be appreciated that the cutting need only be substantially similar. A variation or deviation from such cutting being identical can be compensated for in the stitching of the panels together. The stitching and/or embroidering can bridge any gaps that may exist between complementary edges of two panels as a result of inaccuracies in their cut. Similarly, the shapes of at least two cups from which at least two panels are respectively cut need only be substantially similar and need not be exactly identical. It is envisaged that a slight variation from the shapes of the two cups being identical will not affect the overall appearance of the assembled cup to any great or appreciable extent. Furthermore, additional cutting of the cup(s) in addition to that to define the at least two panels may also occur. The panel removed in any such additional cutting need not be utilized in the construction of a finished cup but may be discarded. In such a case, the removed panel leaves an aperture in the cup.

What is claimed is:

1. A method of making a molded brassiere cup comprising the steps of:

(a) taking a first and at least one other molded cup with each said cup having a convex side and a concave side, each said cup comprising an outer layer of fabric material at the convex side of said cup and at least one layer of foam or including a foam layer adhered to said outer layer of fabric material on the concave side of said cup, said outer layer of fabric material of at least two of said first and at least one other molded cup being of a different color, (b) cutting each said cup to define at least two portions, said cutting being identical for each said first and said at least one other molded cup to define at least two separated portions of each respective cup to generate at least two separated portions of identical shape, with respective cut edges, (c) fixing along at least part of said cut edge of separated portion(s) cut from the first cup, an at least part of a complementary shaped cut edge of the separated portion(s) cut from at least one other cup, the fixing being at a mating boundary to define a multi-panel cup form substantially of the same shape as said first and said at least one other molded cups.

2. A method as claimed in claim 1 wherein said fixing includes embroidering along the mating boundary of said panels of said multi-panel cup.

3. A method as claimed in claim 2 wherein said fixing includes stitching along the mating boundaries of said panels of said multi-panel cup prior to embroidering along said boundary.

4. A method as claimed in claim 1 further including the molding of said first and said at least one other molded cups prior to their cutting by placing a precursor sheet of (a) an outer layer of fabric material and (b) at least one layer of or including a foam layer adhered to said outer layer of fabric material such that said outer fabric layer is facing a concave shaped molding portion of a molding machine and said at least one layer faces the convex shaped molding portion of said molding machine, and molding said precursor between said molding portions.

5. A method as claimed in claim 1 wherein said multi-panel cup after said fixing has adhered to said concave side thereof a cover sheet of at least one ply of material to cover at least said mating boundaries between said panels of said multi-panel cup.

6. A method as claimed in claim 1 wherein said cover sheet is adhered to said multi-panel cup by the provision of a molding force thereto.

7. A method as claimed in claim 1 wherein said molding force is applied by said two molding portions.

8. A method as claimed in claim 1 wherein said cover sheet is at least co-extensive with the multi-panel cup.

9. A method of making a multi-panel cup for a brassiere comprising;

providing separately molded cups, fixing together at least two panels defining a joint between said panels, each panel generated by the cutting thereof from one of said separately molded cups, each panel having a convex side and each panel being of a different convex side color, said panels being fixed together to define a cup shape substantially identical to the shape of each separately molded cup.

10. A method as claimed in claim 9 wherein said fixing together is by stitching.

11. A method as claimed in claim 10 wherein fixing includes embroidering after said stitching.

12. A method as claimed in claim 11 wherein said embroidering defines elongate embroidery along the joint of said at least two panels.

13. A method as claimed in claim 11 wherein some of said embroidery also extends onto at least one of the panels away from said joint.

14. A cup made in accordance to the method of claim 1.

15. A cup made in accordance to the method of claim 9.

16. A breast cup of a cup shape for a or as part of a brassiere comprising:

a first molded panel of a multiply multi-ply material, at least one other molded panel of a multi-ply material, said panels defining said cup shape, and each said panel is engaged to an adjacent panel in a tessellated manner by stitching along abutting edges of said panels, wherein each said panel has a convex side and has a convex side ply of a fabric material of a different color applied to said panel to which said convex side ply is engaged.

17. A cup as claimed in claim 16 wherein said abutting edges include an embroidered stitching.

18. A cup as claimed in claim 16 wherein over said stitching there is provided a line of embroidery.

19. A cup as claimed in claim 16 wherein said panels have a concave side, a cover sheet is applied to said concave side of said panels substantially coextensive with said cup shape.

20. A cup as claimed in claim 16 wherein said multi-ply material of said panels includes said ply of fabric material having a concave side and on said concave side thereof there is affixed a ply of foam material.

21. A cup as claimed in claim 19 wherein said panels are of foam material and said cover sheet includes a ply of foam material affixed to said foam material of said panels, said panels having a concave side and a ply of fabric material on said concave side of said second mentioned foam material.

22. A cup as claimed in claim 17 wherein said embroidery may also extend onto at least one panel at regions away from said abutting edges.

23. A brassiere incorporating two said breast cups each as claimed in claim 16.

* * * * *

UNITED STATES PATENT AND TRADEMARK OFFICE

CERTIFICATE OF CORRECTION

PATENT NO. : 6,878,033 B2
APPLICATION NO. : 10/354244
DATED : April 12, 2005
INVENTOR(S) : Luk et al.

It is certified that error appears in the above-identified patent and that said Letters Patent is hereby corrected as shown below:

Title page item (75) Inventors: Please add as the co-inventor the name --Zhen Qiang Liu--

Title page, item (12), delete "Luk" and insert --Luk et al.--

Signed and Sealed this

Twenty-fourth Day of February, 2009

John Doll

JOHN DOLL
*Acting Director of the United States Patent and Trademark Office*